United States Patent [19]

Semenov et al.

[11] 3,998,066

[45] Dec. 21, 1976

[54] TUNNEL SHIELD

[76] Inventors: Alexandr Nikolaevich Semenov, 3 Dorozhny proezd, 4, korpus 2, kv. 141; Vazgen Khorenovich Klorikian, Erevanskaya ulitsa, 13, korpus 1, kv. 49; Nariman Alexandrovich Prostov, M. Dorogomilovskaya ulitsa, 23/25, kv. 24; Mikhail Dmitrievich Khalyavkin, ulitsa Chekhovskaya, 1 kv. 231; Ilya Emmanuilovich Reznikov, ulitsa Pavla Korchagina, 8, kv. 47; Izmail Makhmudovich Gergokov, ulitsa Moldagulovoi, 9, korpus 2, kv. 11; Jury Matveevich Gapanovich, ulitsa Artekovskaya, 5, korpus 1, kv. 67; Nikolai Pavlovich Evdokimenkov, Kuzminskaya ulitsa, 48, korpus 3, kv. 131, all of Moscow; Josif Davydovich Fishman, ulitsa Mashinostroitelya, 13, kv. 20, Yasinovataya Donetskoi oblasti, all of U.S.S.R.

[22] Filed: Feb. 6, 1975

[21] Appl. No.: 547,880

[52] U.S. Cl. ..... 61/85

[51] Int. Cl.[2] ..... E21D 9/04

[58] Field of Search ..... 61/85, 84, 45 D; 299/31, 33

[56] References Cited

UNITED STATES PATENTS

| | | | |
|---|---|---|---|
| 3,431,737 | 3/1969 | Bower | 61/45 D |
| 3,558,192 | 1/1971 | Shmakov et al. | 61/85 X |

FOREIGN PATENTS OR APPLICATIONS

| | | | |
|---|---|---|---|
| 93,519 | 8/1897 | Germany | 61/85 |
| 1,182,282 | 11/1964 | Germany | 61/85 |
| 1,459,869 | 11/1968 | Germany | 61/85 |
| 6,509,733 | 1/1966 | Netherlands | 61/85 |

*Primary Examiner*—Paul R. Gilliam
*Assistant Examiner*—David H. Corbin
*Attorney, Agent, or Firm*—Haseltine, Lake & Waters

[57] ABSTRACT

A shield comprises a knife ring with vertical and horizontal partition knives disposed therein for breaking rock. The horizontal partition knives are pivotally connected to the horizontal platforms, adapted to turn in the vertical plane.

Each platform is spring-loaded so that when broken rock is loaded on the platform, the latter, under the weight of the rock, tilts downwardly in the vertical plane, and as the surplus rock is being unloaded, the same spring force returns the platform to the initial position.

4 Claims, 6 Drawing Figures

TUNNEL SHIELD

The present invention relates to the field of tunnel construction, and more particularly to shields for driving tunnels.

The shields for driving tunnels provide a possibility of carrying out tunnelling operations safety and with high efficiency in various categories of rocks and particulaly in loose and insecure rock.

Known in the prior art are shields for driving tunnels whose knife portions are equipped with horizontal and vertical partition knives for cutting rock and maintaining the face in a stable condition. For the purpose of controlling the rate of reception and removal of the broken rock, under varying physico-mechanical properties thereof, both along the face cross-section and along the tunneling route, the shields are equipped with platforms of various designs secured, as a rule, to the horizontal partition knives.

Thus, for example, widely known is a shield design wherein the platforms are secured to the horizontal partition knives with the aid of roller bearings providing their displacement along the partition knives.

Known in the prior art are shield designs wherein the platforms are pivotally mounted on the horizontal partition knives. Such mounting makes possible forced tilting of the platforms in the vertical plane, for which purpose provision is made fo special vertical links connected to the mechanisms for tilting the platforms.

Control of the platform position during the operation of such a shield can be effected only by an operator thoroughly experienced in working under similar mining and geological conditions, who must be able to permanently provide a qualified assessment of the face condition to ensure its stability and minimum effort for advancing the shield.

In practice the physico-mechanical properties of rock along the cross-section of the face are often different, and it is particularly so when using tunnelling shields of large diameter. Therefore, even a skilled operator is usable to control the tunnelling operations in optimal modes, i.e. to pre-set the required positions of the horizontal platforms simultaneously along the entire cross-section of the face which is liable to upset the stability of the face or overload the shield hydraulic jacks and the tunnel timbers.

For the purpose of eliminating manual operations in controlling the process of tunnelling, special automatic devices executing individual control of the position of horizontal platforms have been developed. Monitoring and setting sensors are used to follow up the position of the horizontal platforms according to the volume of extracted rock. These sensors are connected to the actuating mechanisms for rotating the platforms through a train of mechanical, electrical and hydraulic devices.

A disadvantage of such a shield consist in that the automatic devices in association with the actuating mechanisms, e.g. hydraulic cylinders, feature delayed response and thus fail to execute rapidly enough the commands from the monitoring devices. The latter circumstance is of particular significance when insecure rock is replaced by loose rock. In such cases the delayed execution of the command results in hazardous inflow of the rock into the shield. Apart from that, such systems, as practice has shown, are complicated, not very reliable in subterranian conditions of operation, expensive to be produced and maintained.

An object of the present invention is to provide a tunnel shield that would ensure a possibility of self-adjusting the position of the platform when dumping the broken rock depending on the volume of the latter under various conditions of tunnelling in loose and insecure rock.

Another object of the invention is to increase the speed and improve the productivity of the tunnelling shield.

This object is accomplished by providing a tunnelling shield in loose and insecure rock, comprising a knife ring with vertical and horizontal partition knives arranged therein for cutting rock, and horizontal platforms pivotally connected to said horizontal partition knives with a provision made for the platform to be tilted in the vertical plane to a position that ensures the removal of surplus rock therefrom, each platform, according to the invention, being spring-loaded so that when surplus rock is loaded on the platform the latter, under the weight of the rock will tilt down in the vertical plane, and after the rock is unloaded the same springs will return the platform to the initial position.

Such an embodiment of the device will make it possible to improve the productiveness of the shield and increase the speed of tunnelling.

Each platform can be spring-loaded with a laminated spring whose one end is fastened so that it can rotate in the vertical plane on the horizontal partition knife, whereas mounted on the other end of the platform is a roller interacting with the platform when the latter is tilted, with a strip being secured to the horizontal partition knife to support the middle portion of the semi-spring for restricting its movement in the vertical plane.

The above design is simple in construction, reliable in operation and will ensure operational safety.

Each platform can also be spring-loaded with a cylindrical spring whose one end is fitted on a cylindrical guide provided with a longitudinal slot and fastened so that it can rotate in the vertical plane on the horizontal partition knife, whereas the opposite end of the spring is supported by a cylindrical support having an internal threaded opening which accommodates a slide block passing through the slot of the cylindrical guide, with a double-arm lever being fastened to the horizontal platform so that the former can turn in the vertical plane, with one end of the lever resting through a ball support on the cylindrical support, and the other end having a screw which sets the initial position of the platform.

The above design makes it possible to adjust the stiffness of the spring for a desired position of the platform enabling the intial position of the platform to be controlled in a wide range depending on the conditions of tunnelling.

In accordance with the present invention the platforms can be of a resillient material and mounted on the horizontal partition knives in a cantilever manner, whereby, as the surplus broken rock is piled on the platform, the weight of the rock tilts the platform down in the vertical plane, thereafter as the rock is dumped off the platform the latter returns to the intial position.

With the platforms having the herein-disclosed design, the operation of the shield becomes reliable under diverse conditions of tunnelling in incoherent and insecure rock.

Given below is a specific embodiment of the invention with reference to the accompanying drawings wherein.

EXAMPLE 1

Figure 1:
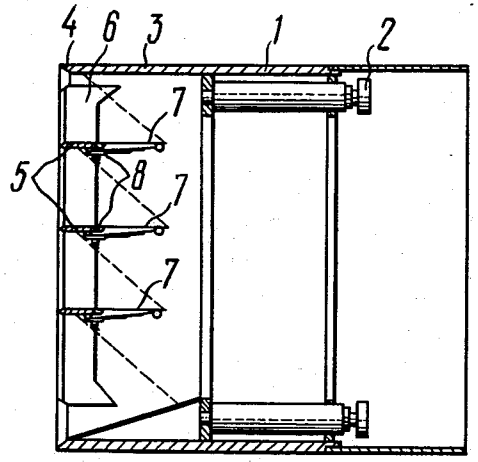
FIG. 1 is a longitudinal section of the knife portion of the shield according to the invention.

A shield for driving tunnels from 2 to 6 m in diameter, in loose and low-stability rock comprises a housing 1 (FIG. 1), shield hydralic jacks 2, a knife ring 3 with a sharpened edge 4, horizontal partition knives 5 and vertical partition knives 6, rigidly fastened to the knife ring 3 of the shield.

The horizontal platforms 7 for receiving and removing the surplus rock are connected to the horizontal partition knives 5 at the side opposite the face.

The platforms 7 are connected to the horizontal partition knives by means of pivots 8.

Each platform 7 is spring-loaded so that when surplus rock piles up on the platform the latter will turn downward in the vertical plane under the weight of the rock and as the broken rock is removed, the same spring returns the platform 7 to the intitial position.

Figure 2:
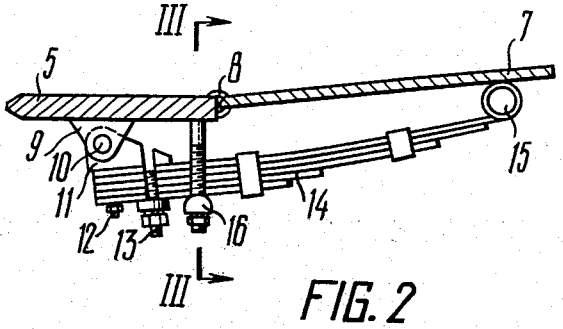
FIG. 2 is a longitudinal section of a device for spring-loading the platform by means of a laminated semi-spring according to the invention.

To spring-load the platform 7, use is made of the support 11 pivotally suspended on lugs 9 and spindle 10 from the lower and of each horizontal partition knife 5 (FIG. 2), with one end of the laminated semi-spring 14 being rigidly connected to the support 11 by means of a threaded stud 12 and a u-shaped turnbuckle 13, the other end thereof being provided with a support roller 15.

Figure 3:
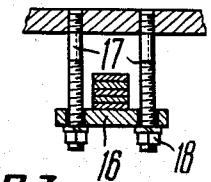
FIG. 3 is a sectional view taken on III—III of FIG. 2.

The laminated semi-spring 14 is supported by a cylindrical strip 16 loose-fitted on two threaded studs 17 (FIG. 3) which are screwed from below into the horizontal partition knives 5, and their opposite ends accommodating nuts 18 which when being rotated displace the strip 16 along the studs 17 and rotates the semi-spring 14 in the vertical plane.

The platform 7 at the side opposite the pivots 8 is freely supported with its lower surface by the roller 15 provided on the end of the laminated semi-spring 14.

The device operates in the following manner.

When the tunnel shield is driven through loose and insecure rock, the rock, cut by the knife edges 4 of the knife ring 3 (FIG. 1), the horizontal partition knives 5, the vertical partition knives 6, as well as desintegrating under the effect of its own weight, falls down, forming on the horizontal partition knives 5 and the platforms 7 (FIG. 2) rock piles of various volumes with slope angles depending on the physico-mechanical properties of the rock.

The vertical load from the platform 7 with the rock thereon is transmitted through the roller 15 to the semi-spring 14 (whose deflection value depends on the size of the rock pile, the properties and condition of rock) turning the platform 7 through a certain angle in the vertical plane. The heavier the piles, the greater the vertical load on the platform, the larger the deflection of the semi-springs 14 and, consequently, the larger the angle of turn of the platform, and therefore, the quicker the surplus rock is removed. As the rock is being removed, the vertical load exerted on the platform 7 is reduced, and due to the stiffness of the semi-springs 14, the platform 7 is returned to the initial position. Therefore, when the shield is in operation, the mode of tunnelling is constantly controlled without the participation of the operator when the physico-mechanical properties of the rock vary, by means of maintaining optimal volumes of rock piles on the horizontal partition knives 5 and the platforms 7, i.e. such volumes which maintain the face in a stable condition and provide minimum resistance to the movement of the shield.

EXAMPLE 2

Figure 4:
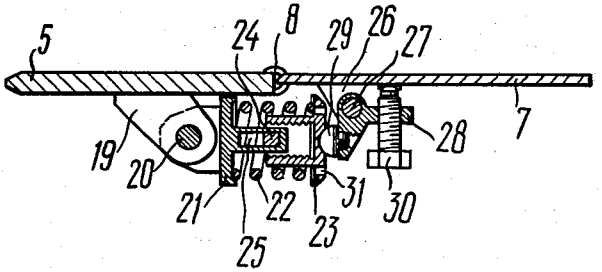
FIG. 4 is a longitudinal section of a device for spring-loading the platform by means of a cylindrical spring according to the invention.

The platform 7 (FIG. 4) can be spring-loaded in the following manner: pivotally-suspended from the lower side of the horizontal partition knife 5 on shackle 19 with the aid of spindle 20 is a guide 21 which mounts and supports a cylindrical spring 22, whose other end is fitted on the cylindrical support 23 having an internal thread and accommodating the threaded slide block 24 passing through the longitudinal slot 25 of the guide 21 and retaining the cylindrical spring 22 on the guide 21 and the support 23 in an assembled condition. Pivotally-installed on the lug 26, 8 and the sprindle 27 from the lower portion of the platform 7 is a double-arm lever 28. One end of the double-arm lever 28 which faces the support 23, has a ball plate 29 conjugating with the ball surface of the support 23 having a spherical recess whose surface corresponds to the surface of the ball plate 29. The other end of the lever 28 is provided with an adjustment screw 30 which supports the platform 7.

The device operates in the following manner.

When the tunnel shield is driven through loose and low-stable rock the latter is broken by the knife edges 4, of the knife ring 3 (FIG. 1), horizontal partition knives 5, vertical partition knives 6, as well as under its own weight forming on the horizontal partition knives 5 and the platforms 7 (FIG. 2) rock piles of various size with slop angles depending on the physico-mechanical properties of the rock.

The vertical load from the platform 7 with the rock (FIG. 4) is transmitted through the double-arm lever 28 to the support 23 and further to the cylindrical spring 22. The deflection value of the cylindrical spring 22 and, consequently, the angle of turn of the platform 7 in the vertical plane are determined by the value of the said vertical load which, in turn depends on the weight and condition of the rock pile located on the horizontal partition knife 5 and the platform 7.

The greater the vertical load exerted on the horizontal platform 7, the larger the angle of its turn in the vertical plane, and the quicker the surplus rock is unloaded off the platform 7. As the surplus rock is being unloaded off the platform 7, the vertical load is decreased and the platform 7 under the effect of the spring 22 is returned to the position close to the initial one.

The initial position of the platform 7 is set prior to starting tunnelling by the adjustment screw 30 on the double-arm lever 28, as well as by pre-tensioning the spring 22.

The pre-tensioning of the spring 22, depending on the physico-mechanical properties of the rock, is achieved by rotating the cylindrical support 23 which is threadably engaged on the slide block 24 passing through the longitudinal slot 25 of the guide 21, and compresses or tensions (depending on the direction of rotation of the support 23) the spring 22.

The rotation of the support 23 is accomplished by means of a special tool, making use of the openings 31 in the support 23.

EXAMPLE 3

Figure 5:
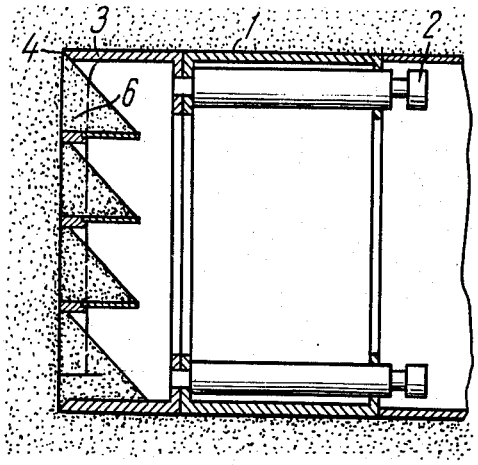
FIG. 5 is a longitudinal section of the knife portion of the shield with platforms made of a resilient material, according to the prevent invention.

The platforms 7 (FIG. 5) for receiving desintegrated rock are manufactured of a resilient material, for example, sheet spring steel having the elastic modulus in the range of about $2.1.10^6$ kg/cm$^2$.

In this case the platforms are fixedly attached to the horizontal partition knives 5 from the side opposite to the face.

The device operates as follows.

When the tunnelling shield is advanced through loose and incoherent rock, the rock cut by the sharp knife edges 4 of the knife ring 3 (FIG. 3), the horizontal partition knives 5, (FIG. 6), the vertical partition knives 6, as well as under the action of its own weight, falls down forming, on the horizontal partition knives 5 and platforms 7 (FIG. 6), rock piles of various volumes with slope angles which depend on the physico-mechanical properties of the rock.

Figure 6:
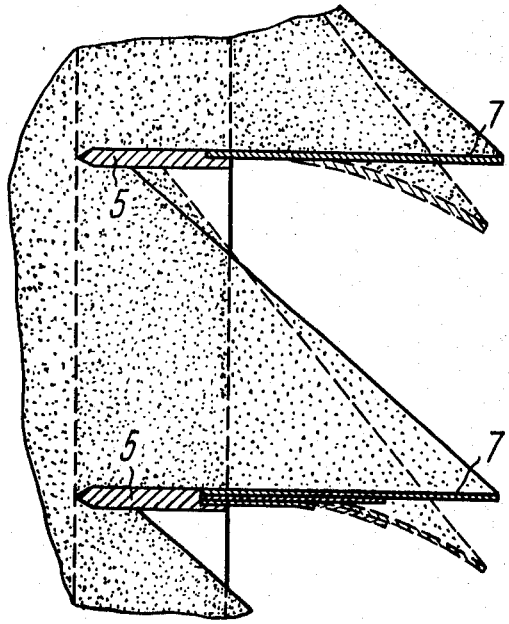
FIG. 6 is a longitudinal section of a platform made of a resilient material, connected to the horizontal knives, according to the present invention.

The vertical load of this rock pile (whose value is determined by the volume of the rock pile, the characteristics and condition of the rock) is transmitted to the platform 7, causing the latter to sag and tilt down in the vertical plane (as shown by the dotted lines in FIG. 6).

The greater the pile of loose rock the greater the vertical load on the platform 7 and the greater the latter will sag and tilt down and thus the quicker the surplus rock is removed from the platform 7.

As the loose rock is dumped off the platform 7, the vertical load thereon decreases and due to the resilience of the platform 7 made of a resilient sheet material it returns to its initial position.

Thus, in operation of the shield there is continuously effected (and that without any effort on the operator's part) control over the mode of excavation of the face in accordance with varying physical and mechanical properties of the rock, by maintaining optimal volumes of the rock piles on the horizontal partition knives 5 and platforms 7, i.e. the volumes which maintain the face in a stable state and ensure minimal resistance to the advance of the tunnelling shield.

The proposed shield for driving tunnels has a simplified design of the knife portion and provides a high reliability of operation of the assemblies which remove the surplus rock from the platform.

The application of the proposed design will provide a continuous control of the process of tunnelling in insecure and loose formations with a practically instantaneous response to varying face stability conditions when the physico-mechanical properties change, for example rock moisture content or cohesion.

What is claimed is:

1. In a shield for making tunnels in loose and low-stable rock, comprising a knife ring; vertical and horizontal partition knives disposed in said knife ring; horizontal proportional platforms connected with said horizontal partition knives so as to alter their position vertically in order to remove crushed rock therefrom, spring means supporting each of said horizontal proportioning platforms for keeping the platform in a given initial position when no load is applied to the platform, the force produced by said spring means being constantly directed against the force of gravity of the rock and having a magnitude so that when rock is delivered in quantities exceeding a predetermined value the platform is tilted downward to enable excess rock to be removed therefrom.

2. A shield as set forth in claim 1 wherein said spring-loading means comprises a laminated semi-spring with one end mounted on said horizontal partition knife so that it can turn in the vertical plane, and a roller on the other end of said semi-spring to interact with said platform as the latter is tilted; and a strip secured to the horizontal partition knife to support the middle portion of said semi-spring for restricting the displacement thereof in the vertical plane.

3. A shield as set forth in claim 1 including a cylindrical guide, said spring means comprising a cylindrical spring with one end fitted on said cylindrical guide, said cylindrical guide having a longitudinal slot and being secured so that it can turn in the vertical plane on said horizontal partition knive, a cylindrical support, the other end of said spring being supported by said cylindrical support, said cylindrical support having an internal threaded opening threadably engaging a slide block therein, said block passing through said slot in said cylindrical guide; a double-arm lever secured to said horizontal platform to turn in the vertical plane, a ball plate, one end of said lever being supported through said ball plate by said cylindrical support, and the other end of said lever having a screw for setting the initial position of said platform.

4. A shield as set forth in claim 1, wherein the platforms are connected in a cantilever manner with said horizontal partition knives on the side opposite to the tunnel face, being made of a resilient sheet material, whereby as the surplus rock is piled on the platforms, the weight of the rock tilts the platforms down in the vertical plane, whereas as the rock is dumped off the platform the latter returns to the initial position.

* * * * *